US005703320A

United States Patent [19]

Lucca et al.

[11] Patent Number: 5,703,320

[45] Date of Patent: Dec. 30, 1997

[54] CONNECTOR FOR BLAST INITIATION SYSTEM

[75] Inventors: Frank J. Lucca, Granby; Daniel P. Sutula, Jr., Farmington; Ronald M. Dufrane, North Granby; Ernest L. Gladden, Granby, all of Conn.

[73] Assignee: The Ensign Bickford Company, Simsbury, Conn.

[21] Appl. No.: 576,003

[22] Filed: Jan. 18, 1996

[51] Int. Cl.[6] ..... C06C 5/04

[52] U.S. Cl. ..... 102/275.7; 102/275.4; 102/275.5; 102/275.11; 102/275.12

[58] Field of Search ..... 102/275.1, 275.2, 102/275.3, 275.4, 275.5, 275.6, 275.7, 275.8, 275.9, 275.11, 275.12, 301, 311

[56] References Cited

U.S. PATENT DOCUMENTS

| | | | |
|---|---|---|---|
| 2,779,280 | 1/1957 | Strange | 102/275.7 |
| 2,923,239 | 2/1960 | Andrew et al. . | |
| 2,952,206 | 9/1960 | Becksted . | |
| 3,175,491 | 3/1965 | Robertson . | |
| 3,205,818 | 9/1965 | Coulson . | |
| 3,669,021 | 6/1972 | Spencer et al. . | |
| 3,878,785 | 4/1975 | Lundborg . | |
| 4,187,780 | 2/1980 | Petruccelli . | |
| 4,248,152 | 2/1981 | Yunan . | |
| 4,299,167 | 11/1981 | Bryan . | |
| 4,312,273 | 1/1982 | Camp . | |
| 4,424,747 | 1/1984 | Yunan . | |
| 4,426,933 | 1/1984 | Yunan . | |
| 4,481,884 | 11/1984 | Yunan . | |
| 4,495,867 | 1/1985 | Mitchell, Jr. et al. . | |
| 4,714,017 | 12/1987 | Kelly et al. . | |
| 4,714,018 | 12/1987 | Lofgren . | |
| 4,716,831 | 1/1988 | Bartholomew et al. . | |
| 4,716,832 | 1/1988 | Sumner . | |
| 4,722,279 | 2/1988 | Yunan . | |
| 4,730,560 | 3/1988 | Bartholomew et al. . | |
| 4,771,694 | 9/1988 | Bartholomew et al. . | |
| 4,815,382 | 3/1989 | Yunan . | |
| 4,821,645 | 4/1989 | Reiss . | |
| 5,162,606 | 11/1992 | Jacob . | |
| 5,171,935 | 12/1992 | Michna et al. . | |
| 5,173,569 | 12/1992 | Pallanck et al. . | |
| 5,192,828 | 3/1993 | Austin et al. . | |
| 5,204,492 | 4/1993 | Jacob et al. . | |
| 5,333,550 | 8/1994 | Rodney et al. | 102/275.8 |
| 5,377,592 | 1/1995 | Rode et al. . | |
| 5,383,405 | 1/1995 | Everest | 102/275.8 |
| 5,423,263 | 6/1995 | Rontey et al. | 102/275.7 |
| 5,463,955 | 11/1995 | Carriere | 102/275.2 |
| 5,499,581 | 3/1996 | Sutula, Jr. | 102/275.7 |
| 5,524,547 | 6/1996 | Kelly et al. | 102/275.7 |

FOREIGN PATENT DOCUMENTS

| | | |
|---|---|---|
| 1203121 | 4/1986 | Canada . |
| 668932 | 6/1977 | U.S.S.R. . |
| 2097516 | 11/1982 | United Kingdom . |
| 2228785 | 9/1990 | United Kingdom . |

*Primary Examiner*—Michael J. Carone
*Assistant Examiner*—Theresa M. Wesson
*Attorney, Agent, or Firm*—Victor E. Libert; Frederick A. Spaeth; David T. Shoneman

[57] ABSTRACT

A connector device (10, 214) for transferring a nonelectric blast initiation signal from a donor line (26, 224) to an acceptor line, e.g., an input stub (24, 217) has donor line retaining means (20a, 20b, 229) for disposing a donor line (26, 224) in signal transfer relation to the input stub (24, 217). An anvil member (27, 130, 226) is provided to support input stub (24, 217) at the point where it is in signal transfer relation with the donor line (26), preferably in conforming contact with the donor line (26). In a particular embodiment, the connector device has a body portion (10a) on which is retained a detonator cap (22). Cap (22) detonates upon receipt of a detonation signal from an input stub (24), optionally after a delay period if delay elements are incorporated into the cap 22. The connector device (10) has retainer spring clips (20a, 20b) for retaining the donor line (26) in signal transfer relation to the input stub (24). An output line retaining member (16) holds the output line (28) in signal transfer relation to the detonator cap (22).

25 Claims, 9 Drawing Sheets

16
18
28
22a
14
10
10b
12b
12a
22
20b
10a
20a
26
24
25
1F
1D
14a
14'
27
10c

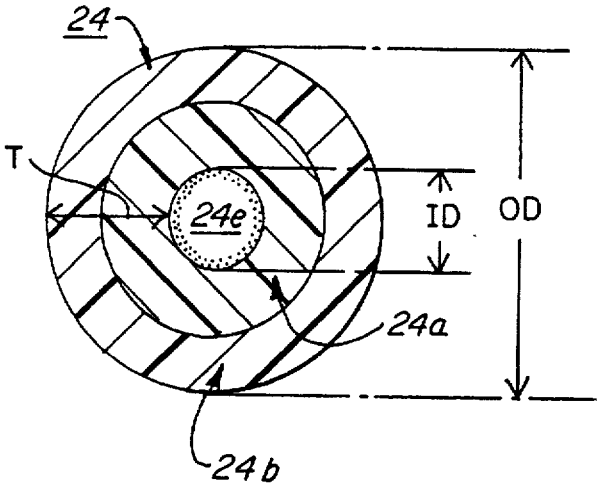
FIG. 1D
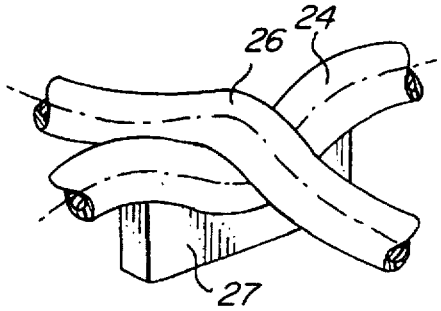
FIG. 2
FIG. 1E
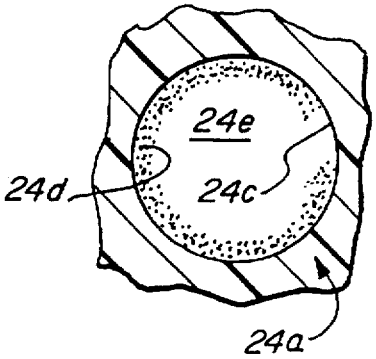
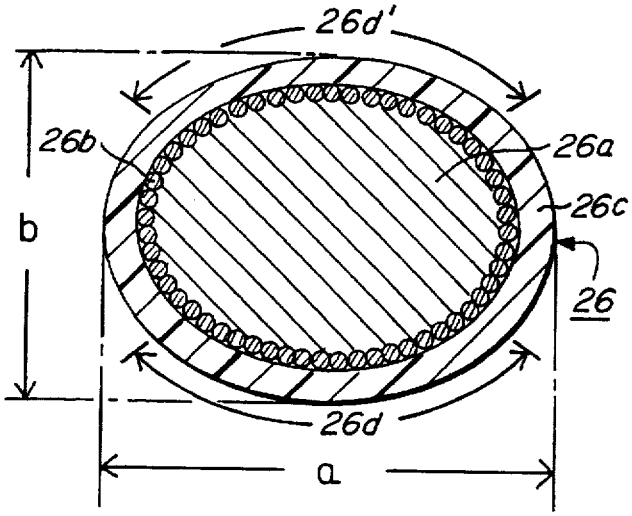
FIG. 1F
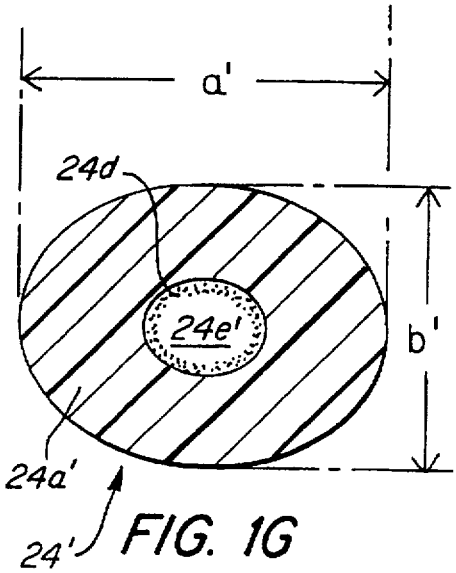
FIG. 1G

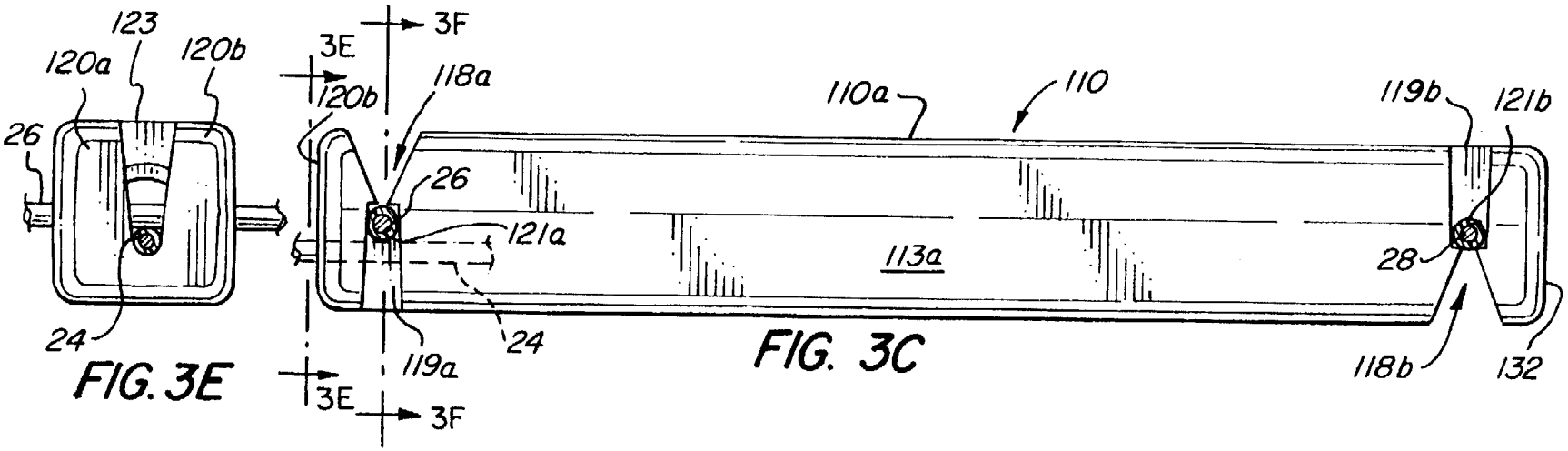
FIG. 3C
FIG. 3E
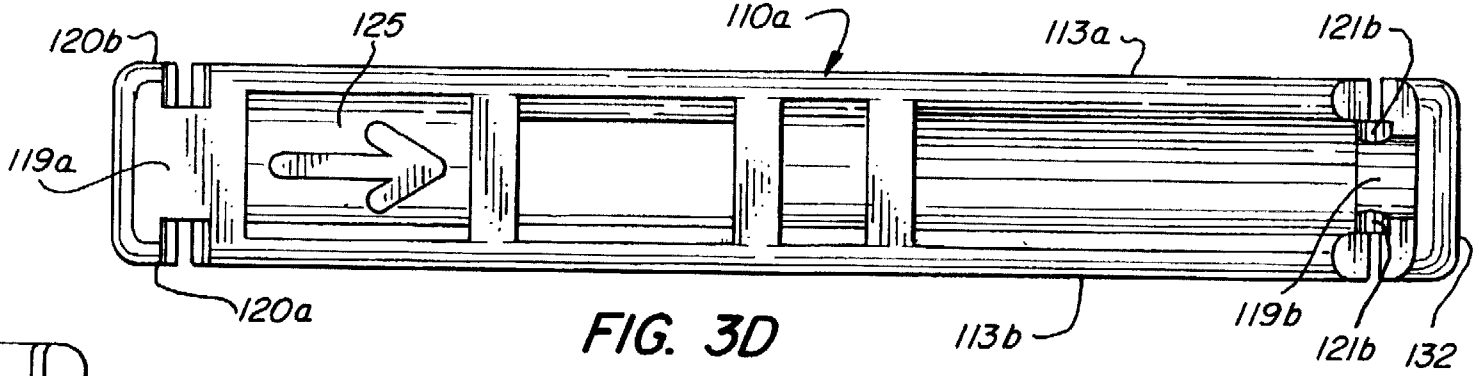
FIG. 3D
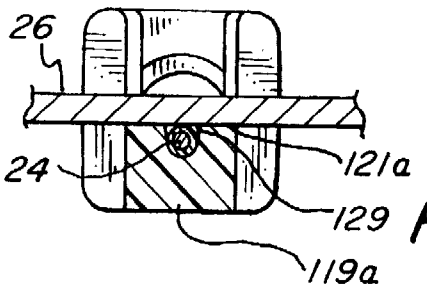
FIG. 3F

CONNECTOR FOR BLAST INITIATION SYSTEM

BACKGROUND OF THE INVENTION

1. Field of the Invention

This invention relates to connector devices for transferring blast initiation signals between signal transfer lines, and more specifically to a connector device which retains a detonator cap which serves to transfer the initiation signal from a donor to an acceptor line.

It is common practice in blasting operations to initiate the detonation of one or more charges by transmitting an initiation signal to charges by means of an initiation signal transmission line. Such signal transmission lines take various conventional forms, e.g., detonating cord, shock tube, etc. Often, it is desired to transfer an initiation signal from one transmission line to another and, in doing so, it is often desired to interpose a delay in the transfer of the signal between the lines. The prior art includes numerous devices for transferring initiation signals from one transmission line to another with a delay interposed therebetween.

2. Related Art

U.S. Pat. No. 5,171,935 to Michna et al, dated Dec. 15, 1992, discloses a connector device comprising a connector block having a channel formed therein for receiving a low-energy detonator cap. The device includes a tube engaging member for holding one or more outgoing signal transmission tubes, e.g., shock tubes, in signal transfer relation to the low-energy detonator cap. The detonator cap is operably attached to an input shock tube which carries an initiation signal from a detonating device disposed at the distal end of the shock tube. The detonator cap may contain a delay element.

U.S. Pat. No. 4,714,017 to Kelly et al, dated Dec. 22, 1987 discloses a connector device that comprises a snap-down, signal donor cord gripping member slidably mounted to a connector body. The donor cord gripping member defines an air gap through which the signal from the donor cord is transferred to a delay element, and then to a primary charge. The donor cord gripping member is slidable so that the position of the donor cord can be chosen to yield the desired delay. The device includes a retaining clip (26) to retain a signal acceptor cord in transverse relation to the output end of the detonator cap.

U.S. Pat. No. 4,716,831 to Bartholomew, dated Jan. 5, 1988, discloses a delay connector device comprising a delay detonator cap having an input stub line. The signal donor line is disposed in parallel signal transfer relation with the input stub line and the signal acceptor line is disposed in signal transfer relation with the delay detonator cap.

SUMMARY OF THE INVENTION

Generally, the present invention provides a connector device configured to retain a brisant signal donor line in conforming contact with an acceptor line wherein the acceptor line is supported by an anvil member at the point of contact with the donor line. In a particular application, the invention may be incorporated into a device that may be used to retain (1) a detonator cap equipped with an acceptor line comprising a signal input stub line, (2) a brisant signal donor line, e.g., low-energy detonating cord, in signal transfer relation with the stub line which provides an acceptor line, and (3) an output line in signal transfer relation with the signal-emitting end of the detonator cap. The detonator cap may optionally be a delay detonator which provides a delay period between (1) signal transfer from the signal donor line to the detonator cap and (2) signal transfer from the detonator cap to the output line.

Specifically, in accordance with the present invention there is provided a connector device for operatively coupling a brisant donor line in signal transfer relation with an acceptor line. In a broad aspect, the device comprises an anvil member for supporting a portion of such acceptor line and donor line retaining means for retaining such donor line in signal transfer relation with such portion of such acceptor line as is supported by the anvil member. The donor line retaining means may comprise at least one spring clip or it may comprise a shroud member. Preferably, the donor line and acceptor line are in conforming contact with each other.

In a particular embodiment alluded to above, the device may have an input end and an output end and may comprise the following components. A body portion comprises a cap-retainer means for retaining a detonator cap having an input end from which protrudes an acceptor line comprising an input stub, and an opposite signal-emitting end. The input stub may comprise a length of shock tube, of detonating cord of suitable strength or of deflagrating tube. The cap-retainer means is dimensioned and configured to retain such detonator cap with its input stub disposed at the input end of the device and its signal-emitting end disposed at the output end of the device. A donor line retainer means, which may comprise a resilient clip means or a donor line slot, is carried on the device for retaining such donor line at the input end of the body portion in signal transfer relation to the input stub of such detonator cap seated within the cap-retainer means. An output line retainer means, which may comprise an output line slot, is carried on the device for retaining an output line at the output end of the body portion in signal transfer relation with the signal-emitting end of such retained detonator cap.

One aspect of the present invention provides for a combination of the connector device with the detonator cap seated within the cap-retainer means.

Another aspect of the invention provides that the connector device further comprises anvil means disposed on the device for supporting such input stub at the point where it is in signal transfer relation with such donor line. Preferably, the anvil means is dimensioned and configured to cooperate with the donor line retainer means, when such donor line is retained within the donor line retainer means and such detonator cap is seated within the cap-retainer means, to retain the input stub and the donor line in conforming contact with each other.

In accordance with another aspect of the present invention, the input stub comprises a length of signal transmission line selected from shock tube, deflagrating tube and low energy detonating cord.

Yet another aspect of the present invention provides for the brisant donor line to be disposed within the donor line retainer means in conforming contact with the input stub. In yet another embodiment of the invention, the donor line is of non-circular cross section to provide at least one flattened segment of the donor line, the flattened segment of the donor line being disposed in contact with the input stub. Alternatively, the donor line may be of circular cross section.

In accordance with still another aspect of the present invention, the cap-retainer means may comprise an enclosure portion defining a bore having a terminal end and being dimensioned and configured to receive and enclose at least the signal-emitting end of the detonator cap with the signal-emitting end received at the terminal end of the bore. In such case the output line retainer means may comprise an output line slot formed adjacent the terminal end of the bore, the output line slot being dimensioned and configured to retain therein at least one output line in signal transfer relation with the detonator cap received in the bore.

In yet another aspect of the present invention, the body portion of the connector device comprises a pair of interconnecting members which, when connected one to the other, define a bore having a terminal end and which is dimensioned and configured to receive and enclose at least the signal-emitting end of the detonator cap with the signal-emitting end received at the terminal end of the bore. The bore may optionally be dimensioned and configured to enclose the entire length of the detonator cap, and the pair of interconnecting members may carry respective first and second locking members which lock the interconnecting members one to the other.

Yet another aspect of the present invention provides that a signal transfer aperture extends between the terminal end of the bore and the output line retainer slot to facilitate signal transfer from the detonator cap to an output line in the retainer slot.

As used herein and in the claims, the following terms have the indicated meanings.

The term "brisant signal donor line" means an initiation signal transmission line, such as detonating cord, that releases sufficient energy upon the initiation of an explosive composition contained therein to initiate a signal in a signal transmission line, such as a shock tube or deflagrating tube, or low energy detonating cord, retained in physical contact with the brisant signal donor line.

The term "conforming contact" of the signal donor line ("line") and the acceptor line means that the donor line and the acceptor line are positioned in contact with each other under sufficient pressure so that at least one of the donor line and acceptor line is curved or deformed in the contact region by the contact pressure, so that at least one line appears to wrap at least partially around the surface of the other. Such deformation or at least partial wrap-around contact increases the area of contact between the donor line and the acceptor line as compared to tangential contact between an otherwise identically relatively positioned identical donor line and acceptor line which are in contact with each other but not under such pressure as to deform or curve one or both in the contact region. Usually, the donor line and acceptor line in conforming contact with each other will be positioned transversely, e.g., perpendicularly, to each other.

BRIEF DESCRIPTION OF THE DRAWINGS

FIG. 1D is a cross-sectional view, enlarged with respect to FIG. 1B and taken along line 1D—1D thereof, of the input stub of the detonator cap shown in FIG. 1B;

FIG. 1E is a cross-sectional view, enlarged with respect to FIG. 1D, of the hollow passageway at the center of the input stub of FIG. 1D;

FIG. 1F is a cross-sectional view, enlarged with respect to FIG. 1C and taken along line 1F—1F thereof, of the brisant donor line shown in FIG. 1C;

FIG. 1G is a cross-sectional view of another embodiment of input stub 24;

FIG. 2 is a partial perspective view of the input stub, donor line and anvil member of FIG. 1B, enlarged relative to FIG. 1B;

FIGS. 3C, 3D, 3E and 3F are, respectively, a side elevational view, a bottom view, an end view, taken along line 3E—3E of FIG. 3C, and a cross-sectional view, taken along line 3F—3F of FIG. 3C, of the connector device of FIGS. 3A and 3B, with FIGS. 3C, 3E and 3F showing a segment of a donor line and an input stub secured to the device;

DETAILED DESCRIPTION OF THE INVENTION AND PREFERRED EMBODIMENTS THEREOF

Figures 1A, 1B, 1C:
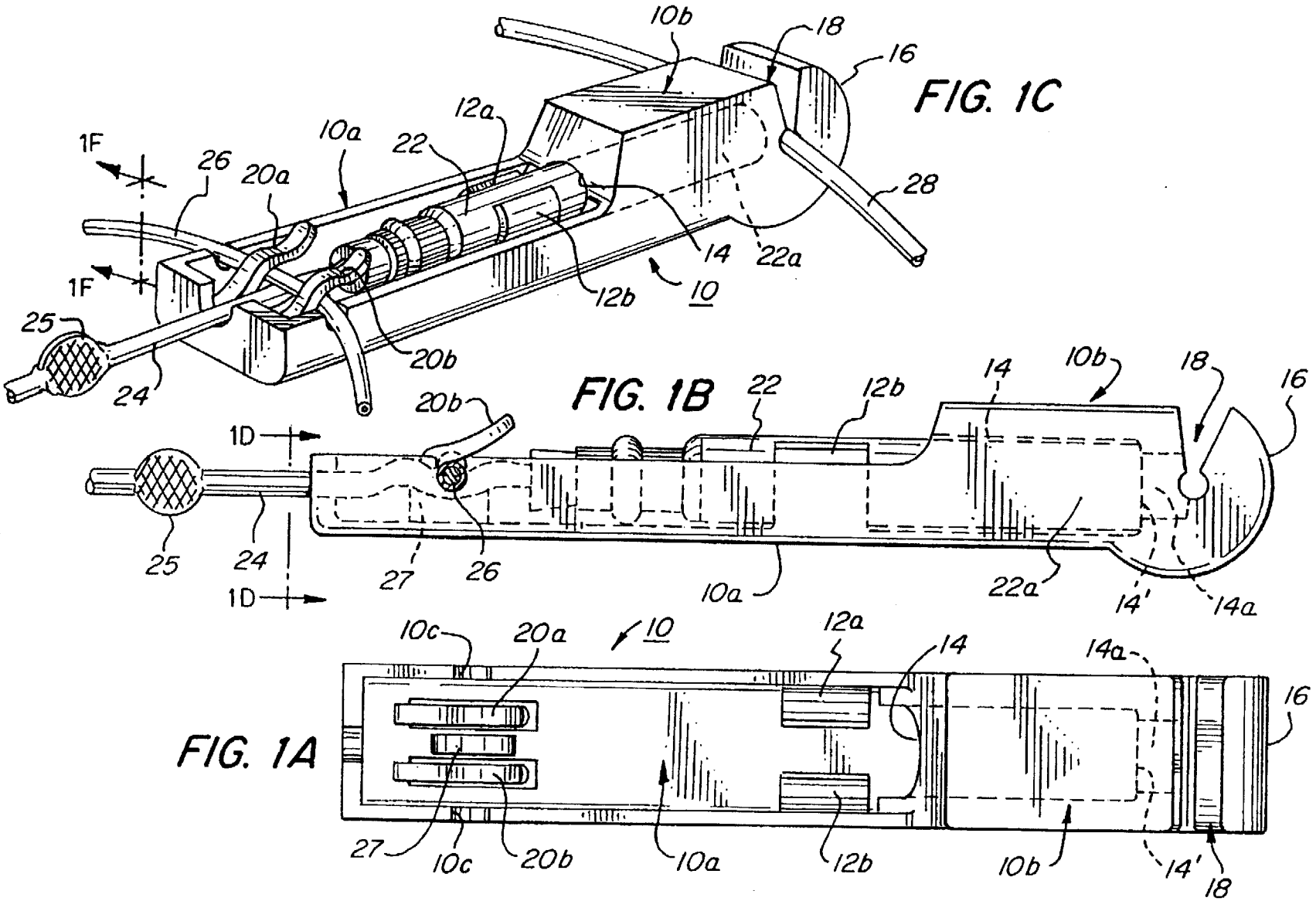
FIG. 1A is a top view of a connector device according to one embodiment of the present invention.
FIG. 1B is a side elevation view of the device of FIG. 1A, in combination with a detonator cap and a signal donor line.
FIG. 1C is a perspective view of the device shown in FIG. 1B, further in combination with an output line.

The present invention provides a connector device for transferring an initiation signal from a brisant signal donor transmission line (referred to herein and in the claims as a "signal donor line" or as a "donor line") to a signal acceptor transmission line (referred to herein and in the claims as a "signal acceptor line" or as an "acceptor line"). The donor line must be able to transfer an initiation signal to the acceptor line by virtue of the outer surfaces of the donor line and the acceptor line being placed in physical contact with each other but not being axially connected to each other. Therefore, brisant signal donor lines are used, e.g., detonating cord donor lines. Non-brisant signal donor lines, e.g., shock tube lines, which conduct a signal therethrough without significant release of energy radially outwardly of the line, would be unable to initiate a signal in an acceptor line merely by virtue of physical surface contact between them.

Conventionally, signal transfer relation between a donor line and an acceptor line is attained by disposing the acceptor line in contact with the donor line. The invention provides improved reliability in the transfer of an initiation signal from a donor line to an acceptor line by disposing the acceptor line against a supporting structure (referred to herein as an "anvil member") at a point where the donor line contacts that acceptor line. In addition, reliability can be further improved by disposing the donor line and the acceptor line in conforming contact with each other.

The invention may be used in a variety of circumstances. For example, the invention finds utility in blasting operations to enable the transfer of a blasting initiation signal from a donor line comprising a surface trunkline comprising detonating cord to one or more acceptor lines comprising downlines comprising detonating cord, shock tube, deflagrating tube, etc. As is well-known to those skilled in the art, shock tube comprises a hollow tube having on the interior thereof a reactive material comprising a pulverulent high explosive usually mixed with a material such as finely powdered aluminum. Deflagrating tube is similar in construction to shock tube except that it contains as a reactive material a pulverulent deflagrating material rather than the pulverulent high brisance reactive material of shock tube.

In a particular embodiment, the acceptor line is an input lead for a detonator that is used to transfer a signal from the donor line to an output line or other device. The detonator is typically used to interpose a delay between the detonation of the donor line and the initiation of the output line or other device, by choosing an appropriate delay detonator, as is well-known in the art. However, a non-delay detonator or "instantaneous" detonator may be used, if desired. The input lead of the detonator may comprise an input signal stub line (sometimes referred to herein and in the claims as an "input stub"), which comprises a length of a suitable signal transmission line, e.g., a short length of shock tube, deflagrating tube or detonating cord of suitable strength. If detonating cord is used, a low energy detonating cord, i.e., one containing not more than about 7 grains per foot of PETN or explosive of similar strength, is preferred. Low energy detonating cord is preferred because it reduces the noise, blast and shrapnel generation as compared to higher strength detonating cords. In the following descriptions of various illustrated embodiments of the invention, the acceptor line comprises the input stub of a detonator, but it will be appreciated that the invention applies equally to other types of acceptor lines, as discussed below. A connector device according to the present invention comprises means for retaining the donor line in signal transfer relation to the input stub, e.g., in physical contact with the stub.

The connector device of the present invention is well-adapted for use on the surface of a blast site as part of a blasting set-up which may include a large number of boreholes interconnected one to the other by signal transfer lines laid onto the surface of the ground. It is therefore highly desirable that the explosive energy of the detonator caps and the brisant donor lines be as low as possible consistent with reliable initiation of input stub acceptor lines of the detonator caps or other acceptor lines. Acceptor lines comprised of shock tubes or deflagrating tubes are essentially silent and do not expend explosive energy outwardly of the tubes so as to create shrapnel or other explosive debris. An acceptor line may also comprise detonating cord of suitably low strength, i.e., a low energy detonating cord. Thus, the acceptor lines may be comprised of either shock tube, deflagrating tube or low energy detonating cord. Detonator input stub acceptor lines generally comprise shock tube. On the other hand, the brisant donor lines are essentially explosive in nature and it is highly desirable to reduce the explosive output of the brisant donor lines to the minimum required to assure reliable initiation of the input stubs of the detonator caps and downlines. Similarly, the explosive output of detonator caps, when employed, is desirably as low as possible consistent with reliable initiation of the output lines or other devices. It is further desirable, as shown in the illustrated embodiments discussed in detail below, to enclose at least the signal-emitting end of the detonator caps, that is, the ends of the detonator caps containing the output explosive, within a bore of the connector device so as to reduce the amount of shrapnel dispersed by its detonation. It has been found that even under the foregoing conditions of reducing to the extent possible the explosive output of the brisant donor lines, the donor line retainer means provides a simple and reliable way to retain the donor line in signal transfer relation to the input stub without requiring that the connector device be assembled or manipulated on site. All that is required on site is simple snap-fit insertion to connect the donor line and the acceptor line to the connector device. This is in contrast to the device disclosed in U.S. Pat. No 4,716,831 to Bartholomew et al, in which the donor line is inserted into a cord clip (16), the acceptor line is inserted into another clip (18) and an upper housing section (10) is lowered onto the lower housing section (12) to close the connector device before use. The connection of donor and acceptor lines using a device according to the present invention is much simpler, and obviates the need to assemble the connector device itself on site.

There is shown in FIG. 1A a connector device 10 in accordance with one embodiment of the present invention. Connector device 10 comprises a body portion **10*a* dimensioned and configured to receive a detonating cap therein, as illustrated in FIGS. 1B and 1C. Body portion 10*a* carries cap-retainer means comprising tabs 12*a* and 12*b* which receive and retain a detonator cap, as illustrated in FIGS. 1B and 1C. Body portion 10*a* includes an enclosure portion 10*b* which defines a bore 14 dimensioned and configured to receive at least the signal-emitting portion of the detonator cap. Bore 14 has a terminal end 14'. A retaining member 16 is attached to body portion 10*a* and defines a slot 18 which communicates with signal transfer aperture 14*a* and which is dimensioned and configured to receive and retain an output line therein. Body portion 10*a* also carries a pair of spring clips 20*a* and 20*b* for retaining a signal donor line. An anvil member 27, which comprises a raised land analogous to anvil 226 of FIG. 6C, is disposed between spring clips 20*a* and 20*b*** to support an acceptor line, i.e., the input stub of a detonator, as discussed below.

Connector device 10 is shown in FIG. 1B in combination with a detonating cord donor line 26 and a detonator cap 22 that is equipped with a shock tube input stub 24 which acts as an acceptor line. Input stub 24 has a first end, which is an open end and which is sealed within the shell of detonator cap 22 and a second, opposite end which is closed at tube closure 25. Closure 25 may be formed by any method effective to seal the end of the tube and thus protect the interior from contamination. For example, closure 25 may be formed by pressing the end of input stub 24 in a hot press die. Donor line 26 may be a detonating cord or other brisant initiation signal transmission line capable of initiating a signal in input stub 24 by virtue of the physical contact of donor line 26 with input stub 24.

As mentioned above, it is desirable to limit the explosive power of brisant donor line 26 to as low a level as is consistent with reliable initiation of input stub 24. Thus, donor line 26 may comprise a low energy detonating cord and may typically comprise a core load of about 0.5 to 2.2 grams per linear meter of a high order explosive such as PETN.

Detonator cap 22 may be an instant acting detonator or a delay detonator cap, both types being of course well-known in the art. Detonator cap 22 includes a signal-emitting end **22*a* which is received in bore 14 and is thus enclosed by enclosure portion 10b. Signal transfer aperture 14a exposes the signal-emitting end 22a of detonator cap 22 to slot 18. Consistent with reducing the explosive force of the components consistent with reliable signal transfer, the size of the explosive charge at the signal-emitting end 22a of detonator cap 22** is desirably limited, e.g., to not more than a total of about 600 mg of primary and secondary explosive, e.g., lead azide and PETN or the equivalent. For example, the primary explosive may comprise about 95 to 100 milligrams ("mg") of lead azide and the secondary explosive may comprise about 500 mg of PETN. Often smaller quantities of explosive are sufficient, e.g., about 25 to 100 mg of lead azide or PETN or the equivalent. Obviously, other suitable primary and secondary explosives may be employed. Reference in the foregoing sentences to "equivalent" explosives means explosive materials which are equivalent in explosive force to PETN or lead azide as the case may be.

Signal-emitting end 22a of detonator cap 22 is positioned against terminal end 14' of bore 14. Spring clips 20a and 20b, only one of which is visible in FIG. 1B, provide donor line retaining means that serve to retain signal donor line 26 in physical contact with input stub 24. Body portion 10a advantageously includes notches 10c (FIG. 1A) to help spring clips 20a and 20b fix the location of donor line 26 and maintain contact between donor line 26 and input stub 24. The design of the retaining means, such as spring clips 20a and 20b and of anvil member 27, will facilitate maintaining one of the surfaces 26d or 26d' (FIG. 1F) in contact with input stub 24. Resilient spring clips 20a and 20b will tend to force donor line 26 to bear against input stub 24. Donor line 26 reacts to the pressure imposed by spring clips 20a and 20b by bending around input stub 24 into a slightly humped configuration, as suggested in dotted outline in FIG. 1B. As seen in FIG. 1B, anvil member 27 has a curved surface that supports the portion of input stub 24 that is in contact with donor line 26 to allow input stub 24 to bend slightly as well. The pressure exerted by spring clips 20a and 20b will force input stub 24 and donor line 26 into conforming, partial wrap-around contact with input stub 24 as is best illustrated in FIG. 2. Thus, donor line 26 and input stub 24 conform to each other, resulting in a greater surface area of contact and more reliable signal transfer from donor line 26 to input stub 24. In situations where donor line 26 is so rigid that spring clips 20a, 20b cannot force donor line 26 to bend into conforming contact with an acceptor line such as input stub 24, the curved surface on anvil 27 can be configured to permit the pressure of spring clips 20a, 20b to bend the acceptor line into conforming contact with the donor line. In such use, the donor line may appear to be substantially unbent, as suggested in FIG. 1C but the advantages of the present invention will be attained nonetheless.

Tests have shown that the provision of such anvil means as anvil member 27 to support an acceptor line at the point of contact with a donor line increases the reliability of signal transfer from the donor line to the acceptor line relative to similarly configured donor and acceptor lines that do not have an anvil member supporting the acceptor line at the point of contact with the donor line.

The disposition of an anvil member to support an acceptor line at the point where the acceptor line contacts a donor line can also be achieved in a connector device for a booster charge assembly (such devices are sometimes referred to as "sliders"). Generally, booster explosive charges are well-known in the art of commercial blasting (e.g., mining, quarrying and construction), for initiating relatively insensitive blasting agents such as ammonium nitrate/fuel oil contained in a borehole. Conventionally, a booster charge is slidably mounted on a detonating cord downline within a borehole. The detonating cord serves to carry an initiation signal from the surface of the blasting site to the booster charge but it does not have sufficient energy to initiate the booster charge. Accordingly, a detonator is used to amplify the initiation signal. Such a detonator typically comprises an input lead to which the initiation signal is transferred from the downline by disposing the input lead in contact with the downline. A connector device is used to dispose the detonator in proper position in the booster charge with the input lead in contact with the downline. Such connector devices are, in general, well-known in the art. However, a connector device in accordance with the present invention comprises an anvil member to support the input lead at the point where the input lead is in contact with the downline. In this case, the detonating cord downline constitutes a donor line and the input lead comprises the acceptor line. Such a connector device is described in copending U.S. patent application Ser. No. 08/548,813, filed Jan 11, 1996, in the name of D. P. Sutula, Jr. et al, for "METHOD AND APPARATUS FOR TRANSFER OF INITIATION SIGNALS in which the anvil member comprises a positioning flange that disposes the input lead of the detonator in abutting contact with the donor line and a gusset to support the flange against deformation when the donor line detonates.

As seen in FIG. 1C, at least one output line 28 is disposed in slot 18, to be retained in signal transfer relation with signal-emitting end 22a of detonator cap 22. Signal transfer aperture 14a (FIG. 1A) serves to guide the output signal from detonator cap 22 directly into slot 18 and onto an output line 28, which will be disposed in slot 18 as shown in FIG. 1C. While FIGS. 1B and 1C show that slot 18 is dimensioned and configured only to receive and retain a single output line, it will be understood that the output end of connector device 10 may be dimensioned and configured to dispose a plurality of output lines in signal transfer relation with detonator cap 22, as shown, for example, in U.S. Pat. No. 5,171,935 to Michna et al, the disclosure of which is hereby incorporated herein by reference. In the Michna et al Patent, the output line slot corresponding to slot 18 has a J-shaped configuration (when viewed from a perspective corresponding to that of FIG. 1B) that generally follows the contour of the detonator cap so that a plurality of output lines can be disposed in contact with the output end of the detonator cap.

As shown in FIG. 1D, input stub 24 is of two-ply construction comprising an inner ply 24a and an outer ply 24b. The combined thicknesses of the two plies defines the wall thickness T and the inside diameter ("ID") of input stub 24 defines a tube inner surface 24c (FIG. 1E) on which is disposed a layer of a pulverulent reactive material 24d, the thickness of the layer of which is greatly exaggerated in FIG. 1E for clarity of illustration. Tube inner surface 24c defines a central passageway 24e of input stub 24. Inner ply 24a may be made from a material such as an ionomeric polymer to which the pulverulent reactive material 24d will readily adhere and outer ply 24b may be made of another polymeric material selected for the properites of tensile strength and mechanical toughness. Input stub 24 may be of any suitable construction, including a single ply of monotube construction, a double ply construction as illustrated or a multiple ply construction utilizing more than two plies. The input stub may comprise "standard" shock tube, which has an outer diameter of about 3.0 millimeters ("mm") and an inner diameter of about 1.1 mm. Other shock tube may be used, if desired. For example, the outside diameter ("OD") of input stub 24 may be not greater than about 2.380 mm and that the ratio of ID to T be from about 0.18 to 2.50, preferably from about 0.83 to 1.33. The outside diameter OD may be from about 1.90 to 2.36 mm and the tube inside diameter may be from about 0.50 to 0.86 mm. The surface density of the reactive material 24d may be from about 0.5 to 7 g/m$^2$ of the area of tube inner surface 24c. The shock tube from which the input stub 24 is preferably made is that disclosed in copending U.S. patent application Ser. No. 08/380,839, filed Jan. 30, 1995, in the name of E. L. Gladden et al for "Signal Transmission Fuse".

Preferably, although not necessarily, donor line 26 is formed to be generally oval or elliptical in cross section as shown in FIG. 1F. Donor line 26 comprises a solid core 26a of an explosive such as PETN which is enclosed by twisted fiber jacket 26b over which has been extruded a polymer jacket 26c which may be made of any suitable material such as a low density polyethylene. The non-circular cross section of donor line 26 is seen to provide a major axis of length "a" and a minor axis of length "b" of the cross section of donor line 26 as well as a pair of major, flattened arc surfaces 26d, 26d' of the exterior surface of donor line 26. The degree of flattening of the cross-sectional profile of donor line 26 is selected to provide an increased surface area of surfaces 26d and 26d' to increase the area of contact of donor line 26 with another line, such as input stub 24. The ratio of the length "a" to length "b" may be from about 1.1 to 1.8, preferably from about 1.4 to 1.6. The result of this construction is that the flattened segment (surface 26d or 26d') of the donor line 26 defines in cross section major and minor arc sections, and a major arc section thereof is disposed in contact with input stub 24.

In order to enhance the contact area between donor line 26 and input stub 24 and further improve the reliability of signal transfer between them, the surface 26d or 26d' is placed into contact with the exterior surface of input stub 24. In part, there will be a natural tendency for the surface 26d or 26d' to align itself in contact with input stub 24. Instead of, or in addition to, providing at least a longitudinal segment (or all) of donor line 26 with a flattened cross-sectional profile, input stub 24 or at least a longitudinal segment thereof may be provided with a flattened cross section as shown in FIG. 1G, which illustrates an input stub 24' of monotube construction comprised of a single ply 24a' of suitable polymeric material having a central passageway 24e' on the walls of which a pulverulent reactive material 24d is dispersed, as in the embodiment of FIGS. 1D and 1E. Input stub 24 preferably has in cross section a major axis of length a' and a minor axis of length b', the ratio of a' to b' being the same as that given above for the ratio of "a" to "b" of FIG. 1F. The flattened segment of the input stub therefore has in cross section major and minor arc sections, and a major arc section thereof is disposable or disposed in contact with the donor line. One of the flattened major arcs of the exterior surface of input stub 24' will be placed into contact with the donor line, e.g., with surface 26d or 26d' of donor line 26 of FIG. 1F, to improve the reliability of signal transfer between the donor line and input stub.

Figures 3A, 3B:
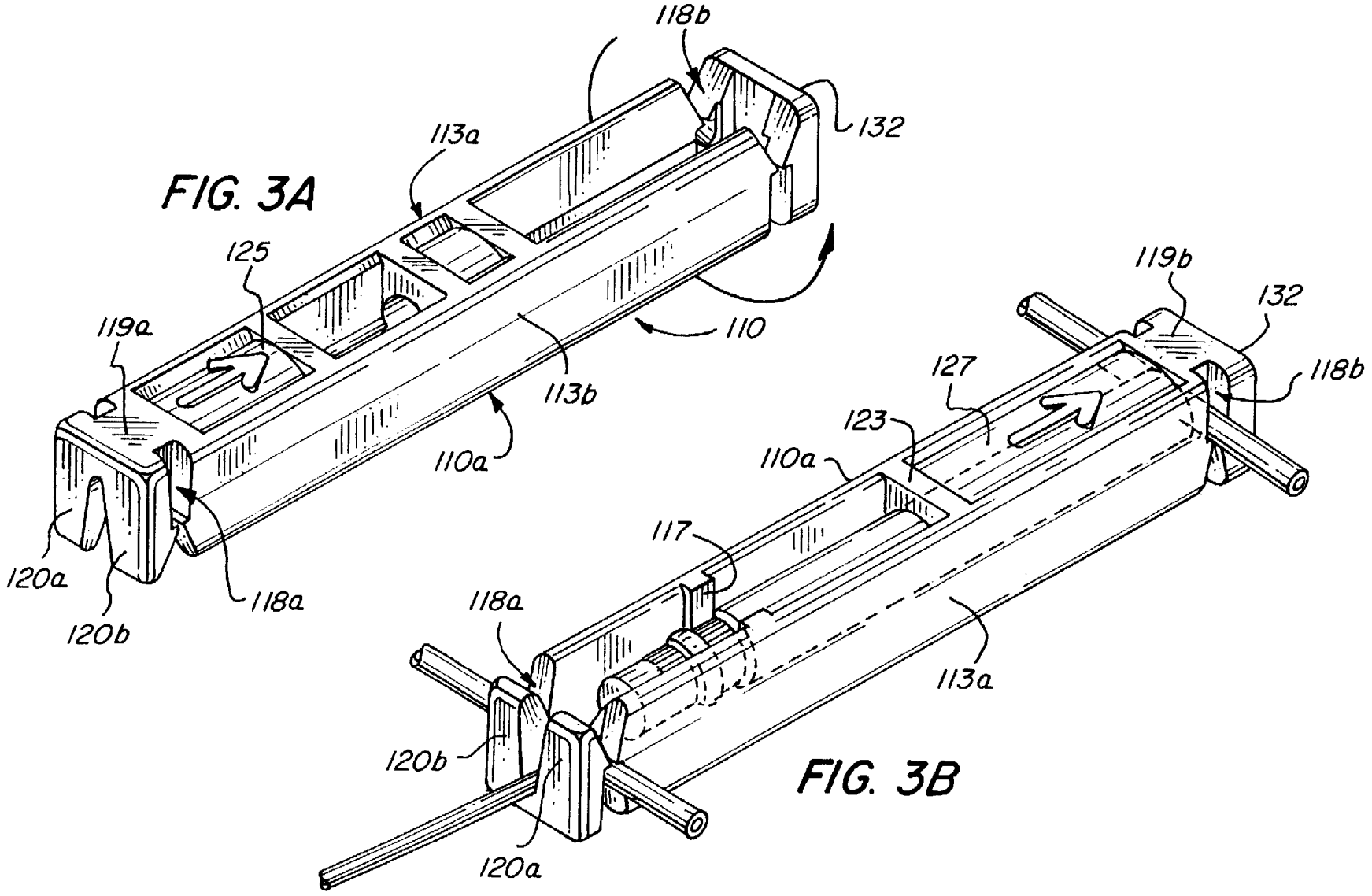
FIG. 3A is a perspective view of a connector device according to another embodiment of the present invention.
FIG. 3B is a perspective view of the connector device of FIG. 3A rotated 180° about its longitudinal axis from its position in FIG. 3A, and showing a detonator cap, a donor line and an output line retained by the device.

FIGS. 3A through 3E show a connector device according to another embodiment of the present invention. Connector device 110 has a substantially rectangular overall configuration comprising a substantially rectangular body portion 110a that comprises two side portions 113a, 113b, and is dimensioned and configured to hold a detonator cap therein. Body portion 110a has two ends and has donor line spring clip means 120a, 120b attached to one end by a neck member 119a and output line retainer means 132 attached at the opposite end by neck member 119b. As can be seen in FIG. 3A, donor line spring clip means 120a and 120b define a slot 118a between donor spring clip means 120a, 120b and the first end of body portion 110a. Slot 118a is open at one side of body portion 110a for insertion of the donor line as shown in FIG. 3B and is closed at the other side by the neck member 119a. Similarly, output line retainer means 132 defines a slot 118b between output line retainer means 132 and the second end of body portion 110a into which an output line may be inserted via the open side, to be retained therein in signal transfer relation with the output end of a detonator cap.

Also visible in FIG. 3A is the cap-concealing wall 125 between side portions 113a and 113b that extends from the first end of body portion 110a towards the second end. Wall 125 covers the input end of a detonator cap disposed in the connector device and bears an arrow indicating the direction in which a signal is transferred by the device. Wall 125 leaves the output end of a detonator cap exposed.

When the connector device of FIG. 3A is rotated 180° about its longitudinal axis as suggested by the rotation arrow (unnumbered), it is disposed in the orientation shown in FIG. 3B, where the device is shown with a detonator cap, a donor line and an output line in place. As sensed in FIG. 3B, the open side of slot 118a is visible at the top side of the device, as is the neck member 119b that closes slot 118b on that side. FIG. 3B also illustrates that the first end of body portion 110a and the donor spring clip means 120a, 120b are dimensioned and configured to accommodate the input stub of the detonator cap, which passes between donor spring clip means 120a and 120b, and to dispose the donor line at right angles to the input stub. It can also be seen that a cap-concealing wall 127 extends from a cap-retaining arch 123 towards the second end of the body portion, and covers the output end of the detonator cap on the top side of body portion 110a, leaving the input end of the cap exposed. Wall 127, like wall 125, bears an arrow indicating the direction of signal travel through the device. A crimp-engaging tab 117 engages a crimp in the detonator cap to help secure the cap in place.

By viewing FIGS. 3A and 3B together, it becomes evident that slot 118a, which receives the output line, is open at a side of body portion 110a that is opposite to the side at which slot 118b is open. The opposing directions to which slots 118a and 118b are open is seen more clearly in the side view of FIG. 3C and in the bottom view of FIG. 3D, in which slot 118a is seen to be closed on the bottom side of body portion 110a but open at the top side of body portion 110a, while the reverse is true for slot 118b. FIG. 3E shows an end view taken along lines 3E—3E of FIG. 3C, in which the cap-retaining arch 123 on body portion 110a is partially visible through the gap between donor line spring clip means 120a and 120b.

Figure 4B:
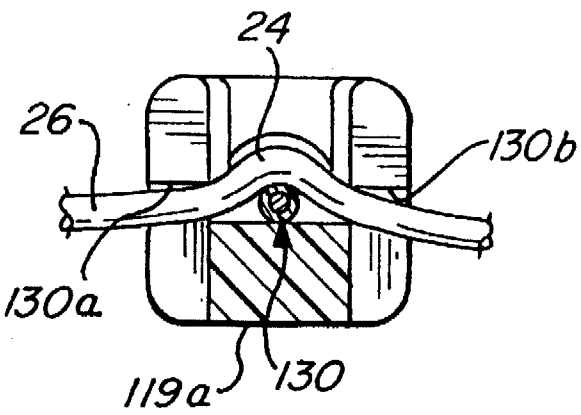
FIGS. 4, 4A and 4B are views corresponding to FIGS. 3C, 3E and 3F, respectively, of an alternate embodiment of a connector device according to the present invention.
Figure 4:
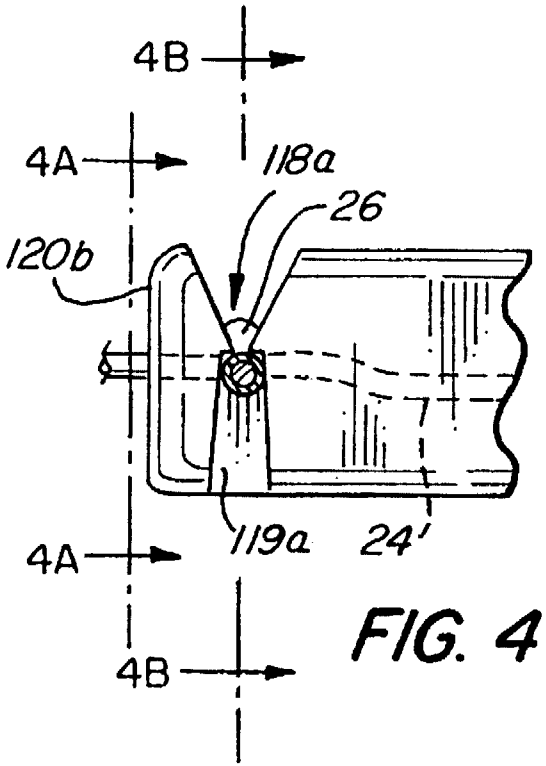
Figure 4A:
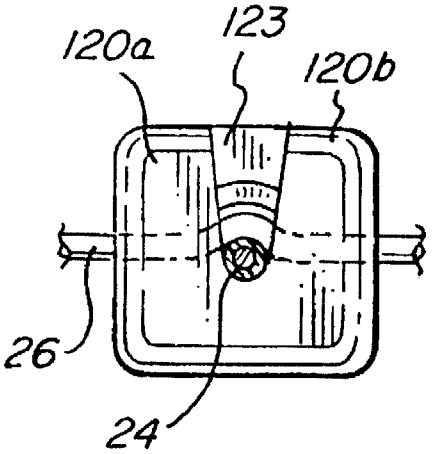

The relative positions of a donor line 26 and an acceptor line comprising input stub 24 secured in connector device 110 are shown in FIGS. 3C, 3E and 3F. Neck member 119a defines a pair of groove seats 121a in which donor line 26 is received; similar groove seats 121b are formed on neck member 119b at the opposite end of body portion 110 to accommodate the output line 28. In addition, neck member 119a defines a longitudinal groove seat 129 (which is analogous to the longitudinal groove seat 129' of the embodiment of FIG. 5C) in which input stub 24 is disposed. As seen in FIG. 3F, seat 129 receives input stub 24 and is recessed relative to seat 121a for donor line 26, so that donor line 26 and input stub 24 are disposed in tangential contact with each other. However, in an alternative and preferred embodiment of the present invention, the connector device of FIGS. 3A and 3B may be modified to include anvil means that positions input stub 24 in conforming contact with donor line 26. That is, the anvil means may cause at least one of donor line 26 and input stub 24 to conform to the other in a curved or bent configuration, thus increasing the reliability of signal transfer between the two. Such anvil means may in one case be provided by reducing or eliminating the seat 129 formed in neck member 119*a* of the embodiment of FIGS. 3–3F. An embodiment showing such modified structure is shown in FIGS. 4–4B wherein input stub 24 is held in an elevated position relative to donor line 26 by an anvil surface 130 which cooperates with lips 130*a*, 130*b* to position input stub 24 and donor line 26 in conforming contact with each other by constraining the two to force donor line 26 to curve around input stub 24 in contact therewith. Accordingly, the surface area contact between input stub 24 and donor line 26 is increased, thereby facilitating the transfer of an initiation signal from donor line 26 to input stub 24. Thus it is seen that the anvil means may comprise cooperating structures such as anvil surface 130 and lips 130*a*, 130*b*.

Figures 5, 5A:
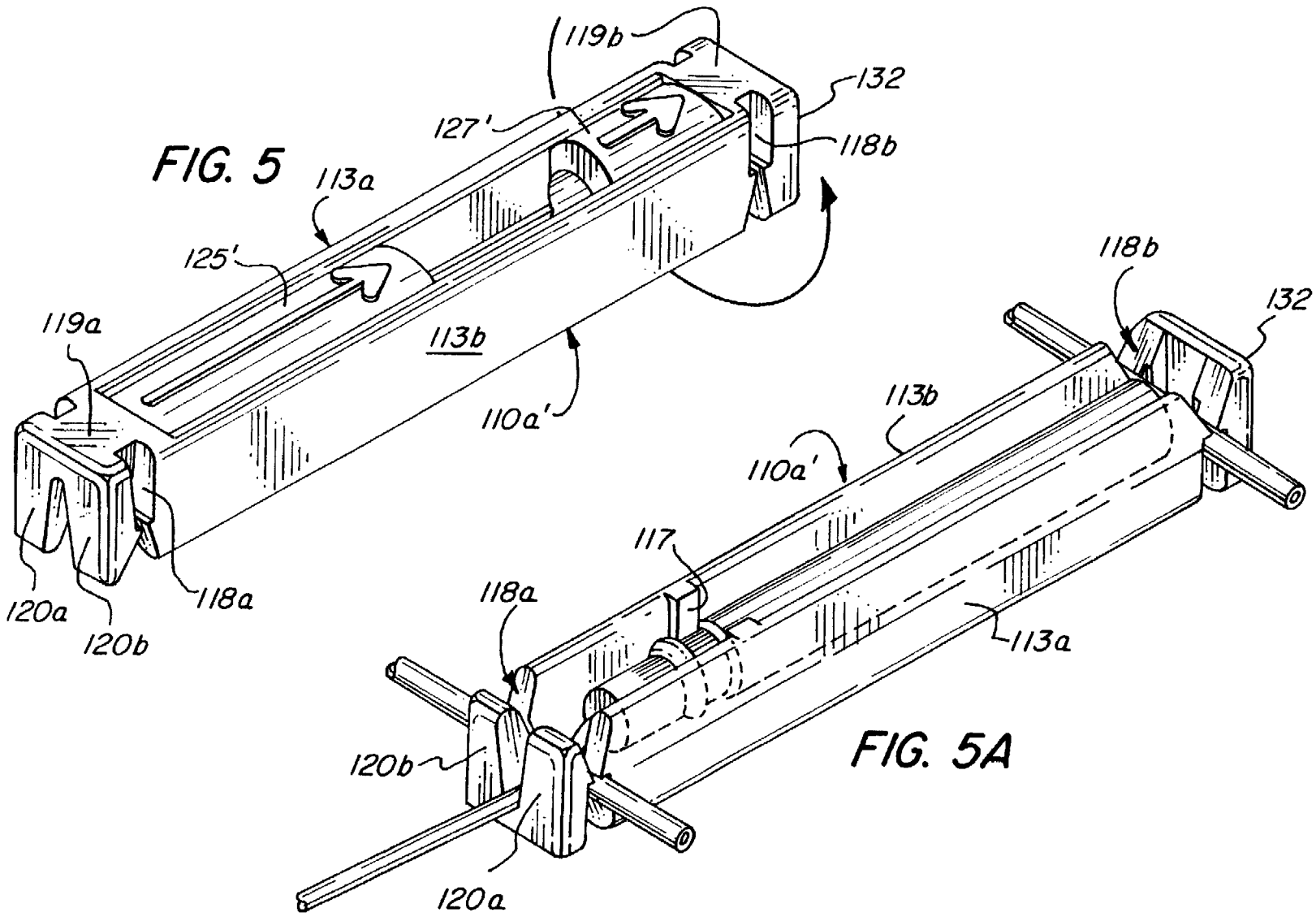
FIGS. 5, 5A, 5B, 5C and 5D are views corresponding to those of FIGS. 3A, 3B, 3C, 3D and 3E, respectively, of a connector device according to yet another embodiment of the present invention, FIG. 5D being taken along line 5D—5D of FIG. 5B.
Figure 5B:
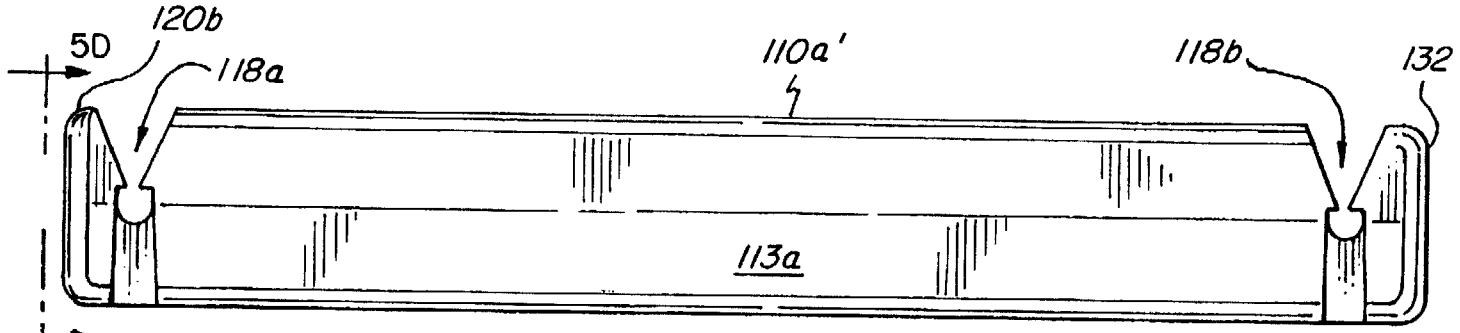
Figure 5D:
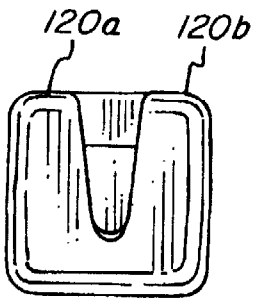

FIGS. 5–5D all pertain to another embodiment of the present invention in which the slots 118*a* and 118*b* face (are open to) the same side of body portion 110*a*'. Thus, as shown in FIG. 5A, the openings of slots 118*a* and 118*b* are disposed in the same direction, e.g., upward as shown in FIG. 5A. The difference between the configuration of slots 118*a* and 118*b* in the respective connector devices of FIGS. 5–5D and of FIGS. 3A–3F can be best appreciated by comparison of FIG. 3C with FIG. 5B. While both embodiments comprise two cap-concealing walls that extend partly along the length of the body portion, walls 125, 127 of the embodiment of FIGS. 3A–3F are on opposite sides (one on the top, one on the bottom) of body portion 110*a*, while in the embodiment of FIGS. 5–5D, both walls 125', 127' are on the same side.

Otherwise, the configuration of the embodiment of FIGS. 5–5D is similar to that of the embodiment of FIGS. 3A–3F, including groove seats 121*a*' and 121*b*'.

Figure 6:
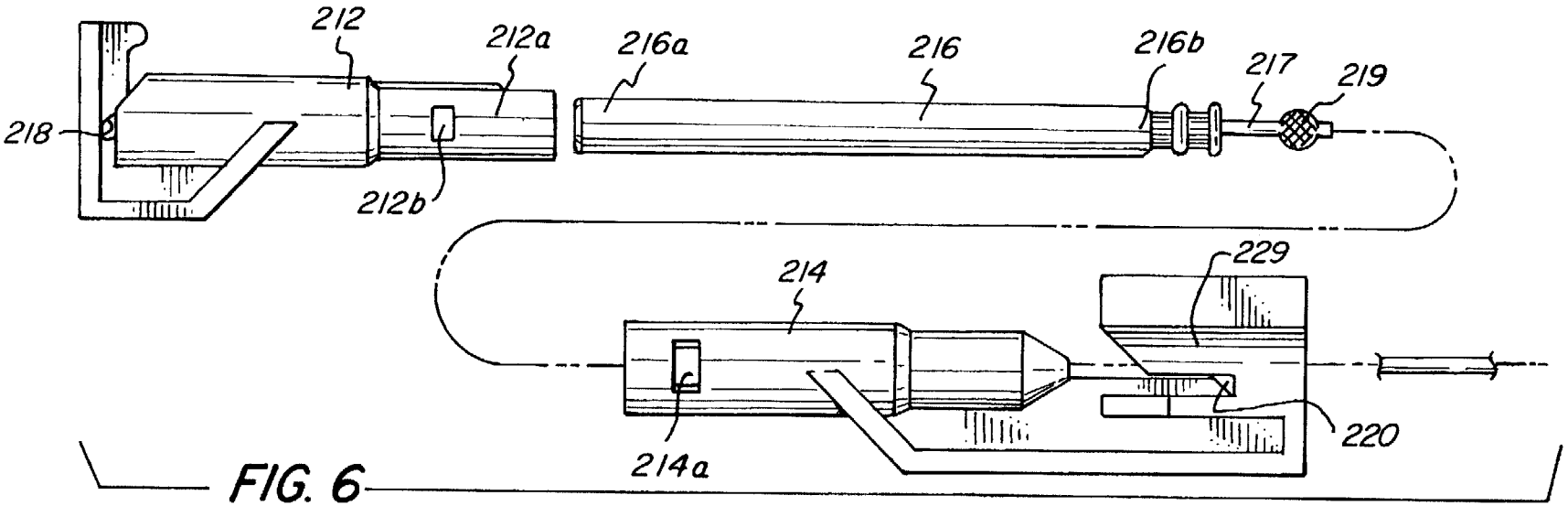
FIG. 6 is an exploded side elevational view of a connector device according to yet another embodiment of the present invention including a detonator cap aligned for mounting within the connector device.
Figure 6A:
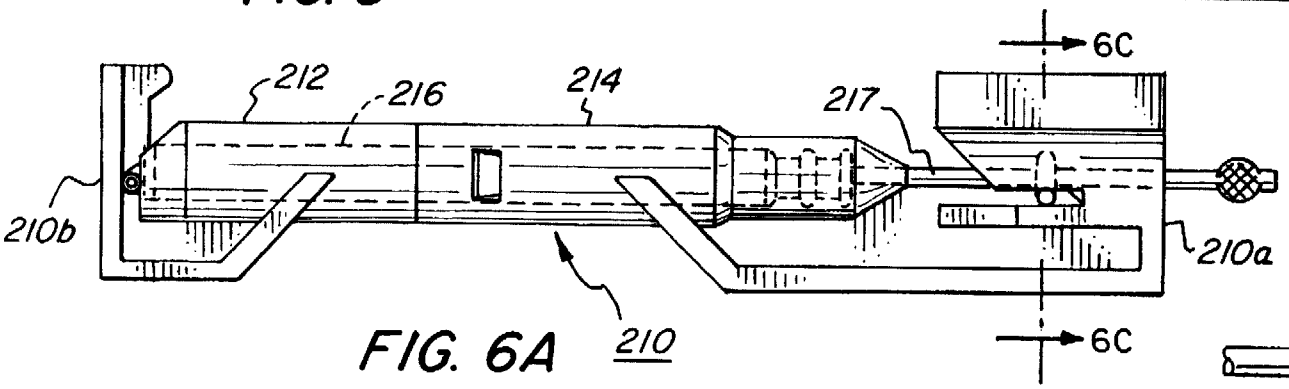
FIG. 6A is an assembled side elevation view of the connector device and detonator cap of FIG. 6.
Figure 6C:
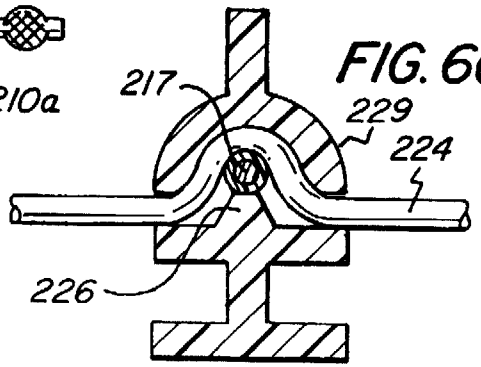
FIG. 6C is a section view taken along line 6C—6C of FIG. 6A.
Figure 6D:
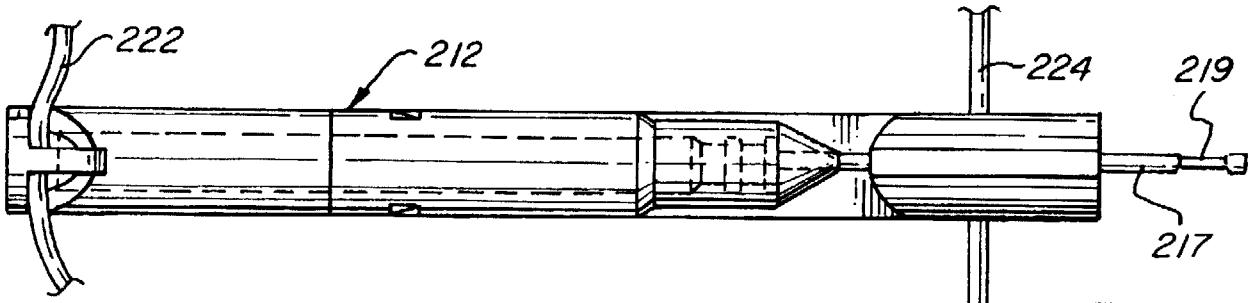
FIG. 6D is a top view of the connector device of FIG. 6A.
Figure 6E:
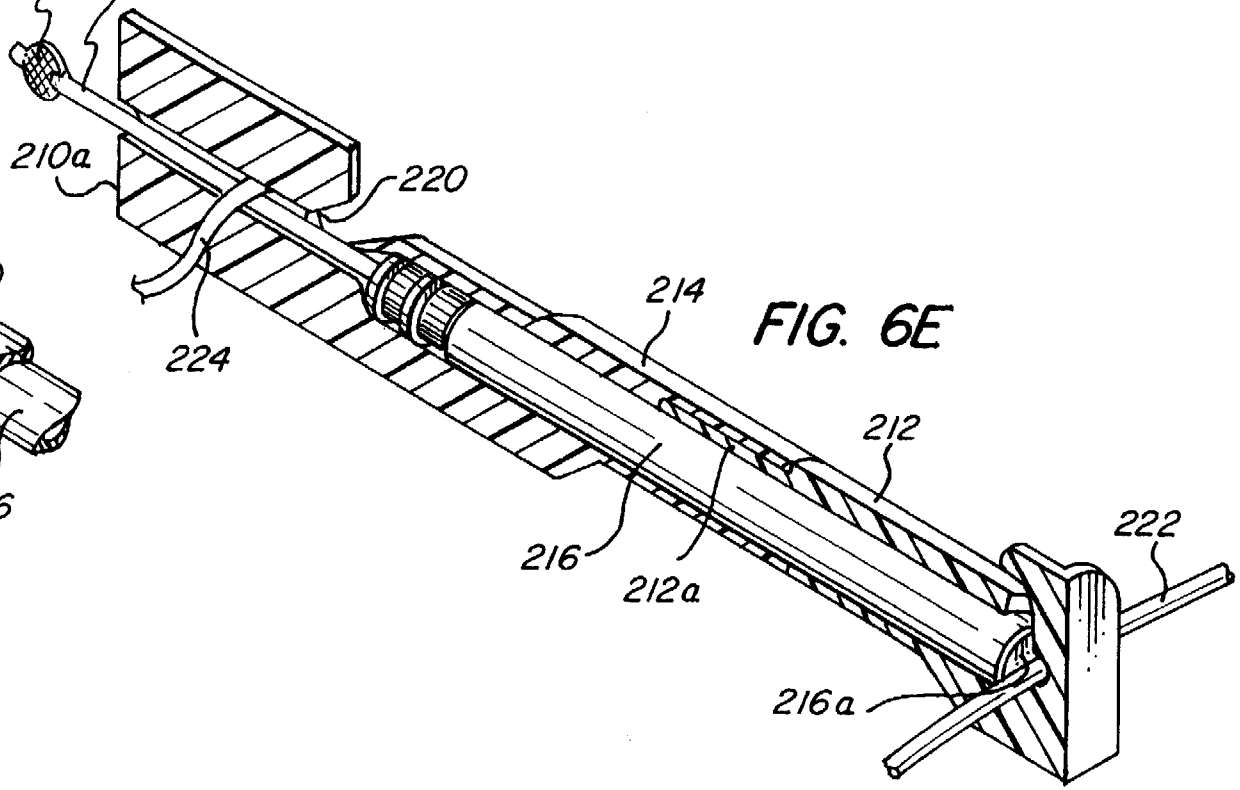
FIG. 6E is a perspective longitudinal section view of the connector device of FIG. 6A.

FIGS. 6–6E illustrate yet another embodiment of the present invention comprising a connector device 210 having an input end 210*a* and an output end 210*b*. Connector device 210 is comprised (FIG. 6A) of a pair of hollow, interconnecting members, first member 212 and second member 214. First member 212 has a probe portion 212*a* which is of smaller diameter than the remainder of the generally tubular portion of first member 212. Probe portion 212*a* is dimensioned and configured to be received within second member 214. A first locking means 212*b* is formed on the probe portion 212*a* of first member 212 and a second locking means 214*a* is formed on second member 214. In the illustrated embodiment, first locking means 212*b* comprises a raised land portion and second locking means 214*a* comprises an opening which is dimensioned and configured to receive by snap-fit insertion therein of the raised land which comprises first locking means 212*b*. Another pair of first and second locking means (not shown), which are identical to 212*b* and 214*a*, are formed on members 212, 214 diametrically opposite locking means 212*b*, 214*a*. An acceptor line slot 218 is formed at one end (the output end 210*b* of device 210) of first member 212 and a donor line slot 220 is formed at one end (the input end 210*a* of device 210) of second member 214.

As best seen in FIGS. 6A and 6E, first and second members 212, 214 are hollow and when connected together as shown in FIG. 6A cooperate to form therein a bore within which a detonator cap 216 is received. Detonator cap 216 has a signal-emitting end 216*a* within which is contained a suitable explosive charge and an input end 216*b* which receives input stub 217 and is crimped about a bushing made of resilient material to seal the interior of detonator cap 216 from the environment. The end of input stub 217 is sealed (FIGS. 6A and 6E) with a seal 219 to close the interior of input stub 217 from the environment. Detonator cap 216 may be an instant acting detonator cap or may, as is well known, contain delay elements to provide a delay period between initiation of a detonation signal within input stub 217 by brisant donor line 224 and detonation of the explosive contained within detonator cap 216 at the signal-emitting end 216*a* thereof.

The connector device 210 may be assembled by inserting input stub 217 of detonator cap 216 into the bore formed within second member 214, with input stub 217 protruding beyond the input end 210*a* of connector device 210. Input stub 217 is then sealed to provide a seal 219 to isolate the interior of input stub 217 from the environment. Alternatively, the passageway provided by donor line slot 220 may be sized to admit passage of seal 219 therethrough. The protruding output end 216*a* of detonator cap 216 may then be inserted into first member 212 as first member 212 and second member 214 are advanced towards each other until first locking means 212*b* engages second locking means 214*a* to securely lock the first and second members 212, 214 together. Usually, such assembly will be completed at the factory although it may be carried out at the blasting site. In either case, the assembled connector block 210 is then ready for field connection to suitable acceptor and donor lines.

Figure 6B:
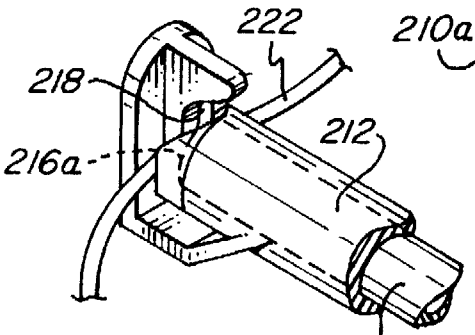
FIG. 6B is a partial perspective view of the output end of the connector device of FIG. 6A.

At the blasting site, an acceptor line 222 may be snap-inserted into acceptor line slot 218 (FIG. 6B) in proximity to signal-emitting end 216*a* of detonator 216, and a brisant donor line 224 may be snap-inserted into donor line slot 220 in conforming contact with input stub 217.

It will be noted, as best seen in FIG. 6C, that an anvil member 226 is provided by a raised, longitudinally extending bead formed within donor line slot 220, an extension of which extends through the donor end 210*a* of connector device 210. A donor line retaining means provided by shroud member 229 extends over and partially surrounds the anvil member 226 to define donor line slot 220 which therefore curves about anvil member 226, as seen in FIG. 6C. (Shroud member 229 is connected to anvil member 226 as a part of second member 214, as seen in FIG. 6.) Both input stub 217 and brisant donor line 224 overlie anvil member 226, which extends for substantially the entire length of donor line slot 220 and to input end 210*a*, so that upon a force-fit insertion of brisant donor line 224 into donor line slot 220, donor line 224 and input stub 217 are placed into conforming contact one with the other. As best seen in FIG. 6C and 6E, anvil member 226 and shroud member 229 cooperate to maintain donor line 224 in conforming contact with input stub 217.

Optionally, second member 214 may be used independently of first member 212. For example, second member 214 may be used to transfer a signal from a brisant donor line 224, which could be a trunkline on the surface of a blast site, directly to a downline acceptor line. Such an acceptor line may comprise the input lead of a detonator situated to initiate a booster charge for a borehole blasting agent and may therefore extend from second member 214 at the surface of the blast site to a point hundreds of feet below the surface. In such an embodiment, the downline acceptor line is disposed in the donor line slot 220 upon anvil 226 in place of input stub 217.

In still other situations, second member 214 may be used in conjunction with first member 212, but they need not be interconnected. Instead, if the detonator in first member 212 has a lengthy input lead 217, second member 214 and donor line 224 may be situated at a point remote from first member 212 and an output line.

The embodiments of FIGS. 3A–3D, 5–5E and 6–6E all provide bores within which substantially the entire length of the detonator cap is received and enclosed, thereby protecting the detonator cap during shipment and connection to acceptor and donor lines.

While the invention has been described in detail with respect to particular embodiments thereof, it will be apparent that upon a reading and understanding of the foregoing, numerous alterations to the described embodiments will occur to those skilled in the art and it is intended to include such alterations within the scope of the appended claims.

What is claimed is:

1. A connector device for operatively coupling a brisant donor line in signal transfer relation with an acceptor line, the device comprising:

an anvil member for supporting a portion of such acceptor line; and donor line retaining means for retaining such donor line in signal transfer relation with such portion of such acceptor line as is supported by the anvil member, the anvil member and the donor line retaining means facing each other and being respectively dimensioned and configured to retain the donor line and the acceptor line in conforming contact with each other.

2. The connector device of claim 1 wherein the donor line retaining means comprises at least one spring clip.

3. The connector device of claim 1 wherein the donor line retaining means comprises a shroud member.

4. A connector device for operatively coupling a brisant donor line in signal transfer relation with an acceptor line, the device having an input end and an output end and comprising:

a body portion comprising cap-retainer means for retaining a detonator cap having an input end from which protrudes an acceptor line comprising an input stub and an opposite signal-emitting end, the cap-retainer means being dimensioned and configured to retain such detonator cap with its input stub disposed at the input end of the device and its signal-emitting end disposed at the output end of the device;

donor line retainer means carried on the device for retaining such brisant donor line at the input end of the body portion in signal transfer relation to the input stub of such detonator cap seated within the cap-retainer means; and output line retainer means carried on the device for retaining at least one output line at the output end of the body portion in signal transfer relationship with the signal-emitting end of such retained detonator cap.

5. The connector device of claim 4 further comprising anvil means disposed on the device for supporting such input stub at the point where it is in signal transfer relation with such donor line.

6. The connector device of claim 5 wherein the anvil means is dimensioned and configured to cooperate with donor line retainer means when such donor line is retained within the donor line retainer means and such detonator cap is seated within the cap-retainer means, to retain the input stub and such donor line in conforming contact with each other.

7. The connector device of claim 5 or claim 6 in combination with the detonator cap seated within the cap-retainer means.

8. The connector device of claim 7 wherein the input stub comprises a length of signal transmission line selected from the group consisting of shock tube, deflagrating tube and low energy detonating cord.

9. The connector device of claim 7 wherein the input stub comprises a length of shock tube.

10. The connector device of claim 7 further including the brisant donor line disposed within the donor line retainer means in conforming contact with the input stub.

11. The connector device of claim 10 wherein at least a longitudinal segment of the donor line is of non-circular cross section to provide at least one flattened segment of the donor line, the flattened segment of the donor line being in disposed contact with the input stub.

12. The connector device of claim 11 wherein the flattened segment of the donor line has in cross section major and minor arc sections and a major arc section thereof is disposed in contact with the input stub.

13. The connector device of claim 11 wherein at least a longitudinal segment of the input stub is of non-circular cross section to provide at least one flattened segment of the input stub, the flattened segment of the inputs stub being disposed in contact with the donor line.

14. The connector device of claim 13 wherein the flattened segment of the input stub has in cross section major and minor arc sections, and a major arc section thereof is disposed in contact with the donor line.

15. The connector device of claim 4, claim 5 or claim 6 wherein the cap-retainer means comprises an enclosure portion defining a bore having a terminal end and being dimensioned and configured to receive and enclose at least the output end of the detonator cap with said output end received at the terminal end of the bore, and wherein the output line retainer means comprises an output line slot formed adjacent the terminal end of the bore, the output line slot being dimensioned and configured to retain therein at least one output line in signal transfer relation with-the detonator cap received in the bore.

16. The connector device of claim 15 wherein a signal transfer aperture extends between the terminal end of the bore and the output line slot.

17. The connector device of claim 4, claim 5 or claim 6 wherein the body portion comprises a pair of interconnecting members which, when connected one to the other, define a bore which has a terminal end and is dimensioned and configured to receive and enclose at least the output end of the detonator cap with the output end of the detonator cap received at the terminal end of the bore.

18. The connector device of claim 17 is wherein the bore is dimensioned and configured to enclose the entire length of the detonator cap.

19. The connector device of claim 17 wherein the pair of interconnecting members carry respective first and second locking means which lock the interconnecting members one to the other.

20. The connector device of claim 5 or claim 6 wherein the output line retainer means comprises an output line slot that is open on one side of the body portion for insertion therein of an output line, and wherein the donor line retainer means comprises a donor line slot open on one side of the body portion for insertion therein of a donor line, and wherein the respective slots are open on the same side of the body portion.

21. The connector device of claim 20 wherein the output line slot and the donor line slot are open on respective opposite sides of the body portion.

22. A connector device for operatively coupling a brisant donor line in signal transfer relation with an acceptor line, the device having an input end and an output end and comprising:

a body portion comprising cap-retainer means comprising an enclosure portion defining a bore for receiving and enclosing at least the output end of a detonator cap having an input stub;

a donor line retainer means attached to the body portion for retaining such brisant donor line at the input end of the body portion in signal transmission relation to the input stub;

the detonator cap having an input end from which the input stub protrudes, and an output end, and being retained within the cap-retainer means with at least the output end of the detonator cap disposed in the bore and the input stub disposed towards the input end of the device and proximal to the donor line retainer means, the input stub comprising a length of signal transmission line;

output line retainer means carried on the connector device for retaining at least one output line in signal transfer relation with the output end of the detonator cap;

the enclosure portion further comprising a signal transfer aperture extending between the detonator bore and the output line slot; and anvil means for positioning the input stub and signal donor line in conforming contact with each other.

23. The connector device of claim 22 wherein the input stub comprises a signal transmission line of a length limited to connect only the donor line and the detonator cap in signal transfer communication.

24. The connector device of claim 22 or claim 23 wherein at least one of the input stub and the donor line has at least a longitudinal segment thereof of non circular cross section to provide at least one flattened segment of at least one of the input stub and the donor line, and the flattened segment is disposed at the point of contact between the input stub and the donor line.

25. The connector device of any one of claims 5, 6, 22 or 23 wherein the detonator cap is a delay detonator cap.

* * * * *

UNITED STATES PATENT AND TRADEMARK OFFICE

CERTIFICATE OF CORRECTION

PATENT NO. : 5,703,320

DATED : December 30, 1997

INVENTOR(S) : Frank J. Lucca et al

Figure 5C:
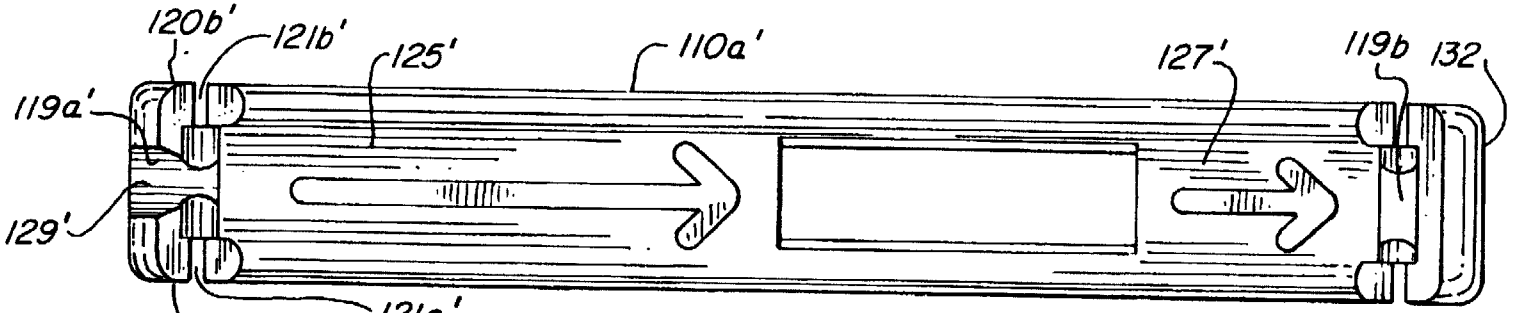

It is certified that error appears in the above-indentified patent and that said Letters Patent is hereby corrected as shown below:

In Figure 5C, replace " 119a' " with --119a--;
replace " 120a' " with --120a--; and
replace " 120b' " with --120b--, so that Fig. 5c appears as shown below:

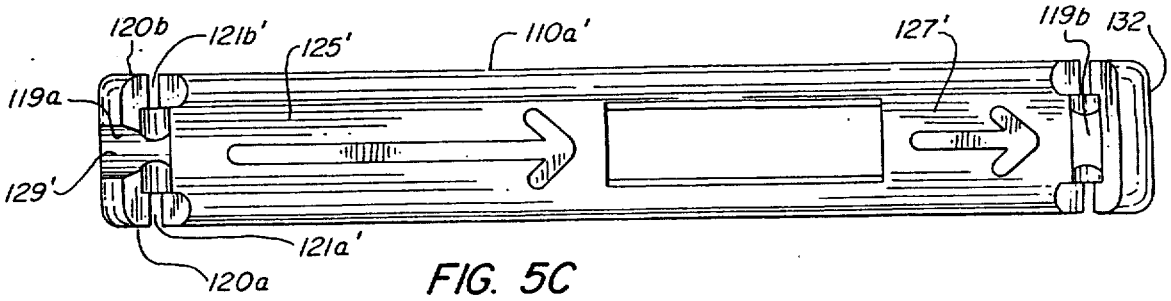

FIG. 5C

UNITED STATES PATENT AND TRADEMARK OFFICE

CERTIFICATE OF CORRECTION

PATENT NO. : 5,703,320

DATED : December 30, 1997

INVENTOR(S) : Frank J. Lucca et al

It is certified that error appears in the above-indentified patent and that said Letters Patent is hereby corrected as shown below:

In the Abstract, line 1, replace "(10, 214)" with --(10, 110, 210)--;
line 4, delete "(20a, 20b, 229)"; and
line 14, after "the" insert --detonator--; replace "22" with --(22)--.

In column 1, line 46, after "Bartholomew" insert --et al--.

In column 8, line 20, place an end quotation mark (--"--) after "SIGNALS".

In column 11, line 9, replace "3-3F" with --3A-3F--; and
line 54, delete "of".

In column 12, line 51, replace "FIG." with --FIGS.--.

In column 14, claim 11, line 4, delete "in"; and
line 5, after "disposed" insert --in--.

In column 14, claim 13, line 4, replace "inputs" with --input--.

UNITED STATES PATENT AND TRADEMARK OFFICE

CERTIFICATE OF CORRECTION

PATENT NO. : 5,703,320

DATED : December 30, 1997

INVENTOR(S) : Frank J. Lucca et al

It is certified that error appears in the above-indentified patent and that said Letters Patent is hereby corrected as shown below:

In column 14, claim 15, line 10, replace "with-the" with --with the--.

In column 14, claim 18, line 1, delete "is".

In column 16, claim 24, line 3, replace "non circular" with --non-circular--.

Signed and Sealed this

Twenty-eighth Day of July, 1998

Bruce Lehman

*Attest:*

BRUCE LEHMAN

*Attesting Officer*

*Commissioner of Patents and Trademarks*